US007808430B2

(12) United States Patent
Carter et al.

(10) Patent No.: US 7,808,430 B2
(45) Date of Patent: Oct. 5, 2010

(54) SCANNED ANTENNA SYSTEM

(75) Inventors: Christopher Ralph Carter, Knebworth (GB); Bernard Paul Gilhespy, Milton Keynes (GB); Alan David Hart, Bristol (GB); Adam Armitage, Bristol (GB)

(73) Assignee: MBDA UK Limited, Hertfordshire (GB)

( * ) Notice: Subject to any disclaimer, the term of this patent is extended or adjusted under 35 U.S.C. 154(b) by 233 days.

(21) Appl. No.: 12/279,494

(22) PCT Filed: Feb. 23, 2007

(86) PCT No.: PCT/GB2007/000648

§ 371 (c)(1),
(2), (4) Date: Aug. 14, 2008

(87) PCT Pub. No.: WO2007/096644

PCT Pub. Date: Aug. 30, 2007

(65) Prior Publication Data

US 2009/0027267 A1 Jan. 29, 2009

(30) Foreign Application Priority Data

Feb. 24, 2006 (GB) ..... 0603718.8

(51) Int. Cl.
*H01Q 3/00* (2006.01)

(52) U.S. Cl. ..... 342/368; 342/371

(58) Field of Classification Search ..... 342/368, 342/371

See application file for complete search history.

(56) References Cited

U.S. PATENT DOCUMENTS 3,378,846 A 4/1968 Lowenschuss (Continued)

FOREIGN PATENT DOCUMENTS

GB 1 485 541 A 9/1977

(Continued)

OTHER PUBLICATIONS

PCT/ISA/210 (International Search Report).

(Continued)

*Primary Examiner*—Thomas H Tarcza
*Assistant Examiner*—Harry Liu
(74) *Attorney, Agent, or Firm*—Buchanan Ingersoll & Rooney PC

(57) ABSTRACT

The invention comprises a feed horn (10) illuminating a circular flat panel (12) formed from a high impedance surface structure. By controlling the resonant frequencies of the individual elements of the array, a controlled phase shift profile is applied across the surface of the panel to an incident phase front spherically spreading from the feed antenna so as to reflect that wavefront in a particular direction or impose a certain desired beam shape. The principles are reciprocal so a receiving system can also be achieved or indeed a simultaneous transmit and receive operation can be supported. The phase controlled reflecting plate advantageously performs focussing to the feed and beam scanning or beam shaping. This concept of feed to a phased reflector plate allows the power distribution to be implemented in free space. In addition, the active component at each array element affecting the resonant frequency is a single varactor tuning diode per element with negligible power dissipation since it operates in reverse bias or a MeMs switch network. A further embodiment is described comprising a transmissive panel with phase shifting elements implemented in MeMs technology coupled to each element of the array. Calibration techniques are described that correct for non-systematic errors in the phase shifts on reflection which would corrupt the beam shape and pointing direction in a practical environment. These can be performed repeatedly, interleaved with the radar or communications waveforms passing through the antenna.

18 Claims, 5 Drawing Sheets

U.S. PATENT DOCUMENTS

| | | | | |
|---|---|---|---|---|
| 5,532,706 | A * | 7/1996 | Reinhardt et al. | 343/778 |
| 6,538,621 | B1 | 3/2003 | Sievenpiper et al. | |

FOREIGN PATENT DOCUMENTS

| | | | |
|---|---|---|---|
| WO | WO 01/73893 | A1 | 10/2001 |
| WO | WO 02/11239 | A2 | 2/2002 |
| WO | WO 2004/093244 | A2 | 10/2004 |

OTHER PUBLICATIONS

PCT/IPEA/409 (International Preliminary Report on Patentability).
United Kingdom Search Report.
Roberto Coccioli et al., "*Aperture-Coupled Patch Antenna on UC-PBG Substrate*", IEEE Transactions on Microwave Theory and Techniques. vol. 47, No. 11, Nov. 1999, pp. 2123-2130.
Dan Sievenpiper et al., "*High-Impedance Electromagnetic Surfaces with a Forbidden Frequency Band*", IEEE Transactions on Microwave Theory and Techniques. vol. 47, No. 11, Nov. 1999, pp. 2059-2074.
Daniel F. Sievenpiper et al., "*Two-Dimensional Beam Steering Using an Electrically Tunable Impedance Surface*", IEEE Transactions on Antennas and Propagation. vol. 51, No. 10, Oct. 2003, pp. 2713-2722.
D.R. Smith et al., "*Composite Medium with Simultaneously Negative Permeability and Permittivity*", Physical Review Letters, vol. 84, No. 18, May 1, 2000, pp. 4184-4187.

* cited by examiner

SCANNED ANTENNA SYSTEM

The present invention relates to phased array antennas and in particular to an improved electronically scanned antenna system.

In phased array antenna systems, a large radiating aperture is achieved by use of a plurality of elemental antennas radiating in phase coherence. Active electronic scanned phased array antennas have distributed transmitter architectures, each element of the array containing a transmit/receive (T/R) module. The T/R module associated with each elemental antenna provides at least phase control of the radio-frequency (RF) signals applied to, or received from, the associated antenna element, so that the net radiation pattern of the array antenna has the desired directional properties. The T/R modules also amplify the received signal with a low-noise amplifier, amplify the signals to be transmitted with a power amplifier, and provide various other functions such as adjustable attenuation and transmit-receive switching.

Hence, each individual T/R module of the array involves numerous high frequency circuits that must be mounted in the region of the associated antenna element. The phase control elements of the array need to be in close register with the elemental antennas and so must be spaced at a pitch sufficient to suppress grating lobes in the radiation pattern. The phase control electronics are sophisticated and for a bidirectional monostatic antenna need to include transmit/receive duplexed transceivers. The extensive power supply and cooling systems associated with such circuits must also be housed in the area behind the antenna elements. In addition, the array elements are driven by a space feed using a horn or by a constrained transmission line feed manifold from a RF signal source. With increasing frequency and increasing antenna size, phased array antennas often exhibit unacceptable losses mainly caused by the feed network.

In airborne radar systems, phased array design presents its own challenges. For aerodynamic reasons, the antenna array is typically located in the interior of a streamlined radome making up the nose section of the aircraft. Such a restricted location presents serious space constraints, in particular, with regard to the circuitry associated with the T/R modules. In a typical aircraft, the antenna array comprises in the region of 1000 to 1200 individual antenna elements occupying an area of the order of 0.8 m diameter within the nose cone. Apart from the volume occupied by the T/R module circuits, the weight associated with such large circuit systems requires a stiffer supporting framework that in turn increases the aircraft load. Moreover, the costs involved in fabrication of such circuits are substantial.

The individual T/R modules require phase and amplitude control not only for steering, but also, to adjust for their own mutual differences and to compensate for any residual errors in the radiators. Since the modules are considerably more active in an active phased array when compared with prior systems employing phase shifters alone, they are prone to drifts in amplitude and phase which causes deterioration of the beam shape and effective antenna gain due to thermal drift or ageing. Hence, continual re-tuning of the array must be carried out after initial range calibration. Current range calibration techniques involve the setting up of a calibration loop around the T/R modules and typically use a far field source to measure the antenna pattern at each angle off boresight for a given pointing angle. Algorithms to re-tune the module are derived from such current range calibration techniques. Since the implied amplitude and phase taper can be found from a fast Fourier transform of the pattern, corrections can then be applied to each module. This method is iterative and must be done for each beam position.

It is an object of the present invention to provide a scanning antenna system that overcomes at least some of the problems discussed above.

From a first aspect, the present invention resides in an antenna system comprising feed means for transmitting a wave front and a panel adapted apply a predetermined phase shift to the transmitted wave front wherein the panel comprises an array of elements, each element being arranged so that it can be switched to a completely absorptive or a nulled state so as to allow independent calibration of individual elements.

The panel may comprise a reflector plate adapted to reflect the phase-shifted wave front towards the feed and the array of elements are formed on a periodic electro-magnetic structure preferably comprising a high impedance surface.

According to another embodiment of the invention, the panel is transmissive and comprises a second feed means on the opposite side of the panel to the transmitting feed means adapted to sample the emergent phase-shifted wave front. The array of elements preferably comprises a plurality of patch antennae disposed on opposite surfaces of the panel.

From a second aspect, the invention resides in a method of calibrating a scanned antenna system, comprising (a) controlling all but a single element of an antenna array panel so as to switch to a completely absorptive or nulled state; (b) modulating a bias voltage or phase shift applied to the single element to be calibrated; (c) determining the phase difference between an incident wave front and the emergent wave front from the antenna panel; (d) calculating estimate values for the offset and the slope from the measured differences; (e) determining the calibration required to achieve a predetermined phase shift on the basis of the estimated values; repeating steps (a) to (e) for all elements of the array.

This invention allows the feed tree to be replaced by a free space spherically spreading wave emerging from a feed antenna which has minimal loss compared to the guided wave structure of the feed tree. The active element at each array antenna is a single varactor diode so offer substantially lower cost over the phased array concept. The number of active devices per element is significantly less and they are less stressed and less delicate compared to low noise amplifiers and power amplifiers. In addition, the minimal size of the varactor control element provides the opportunity of a denser array which offers superior sidelobe structure particularly at large angles away from the main lobe or surface normal.

In order that the present invention can be more readily understood, embodiments thereof will now be described with reference to the accompanying drawings in which.

Figure 4:
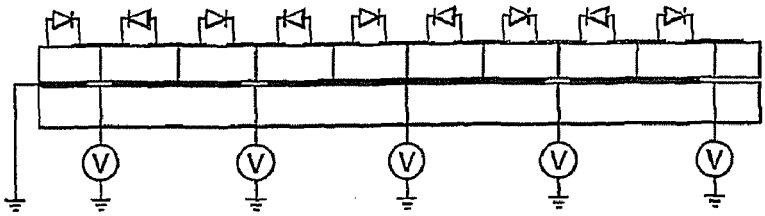
FIG. 4 is a schematic representation of an active high impedance surface with a varactor bias network according to a first embodiment of the present invention.
Figure 6A:
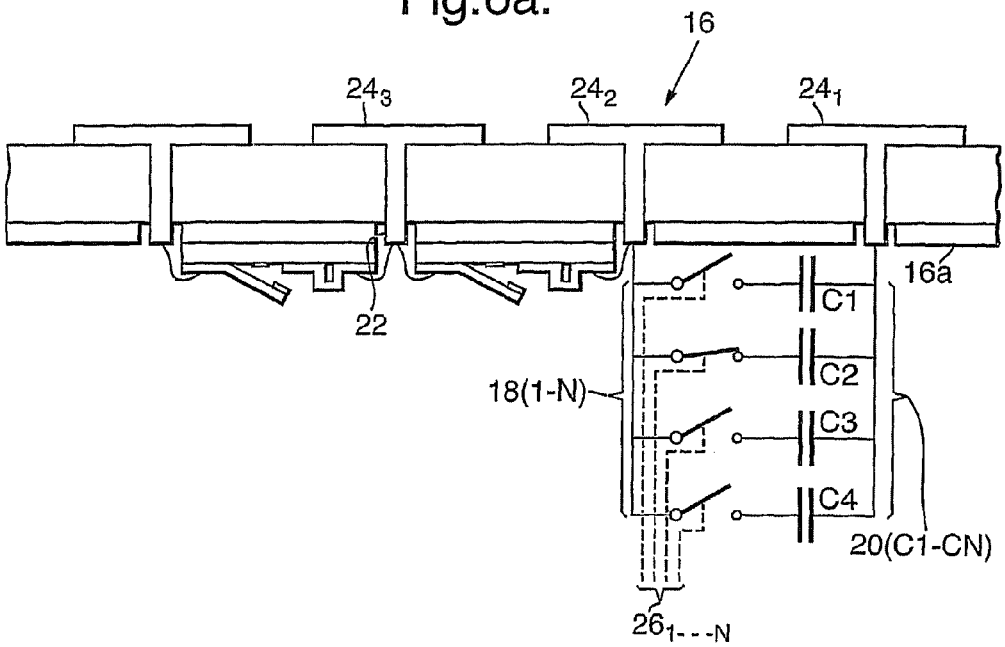
Figure 6B:
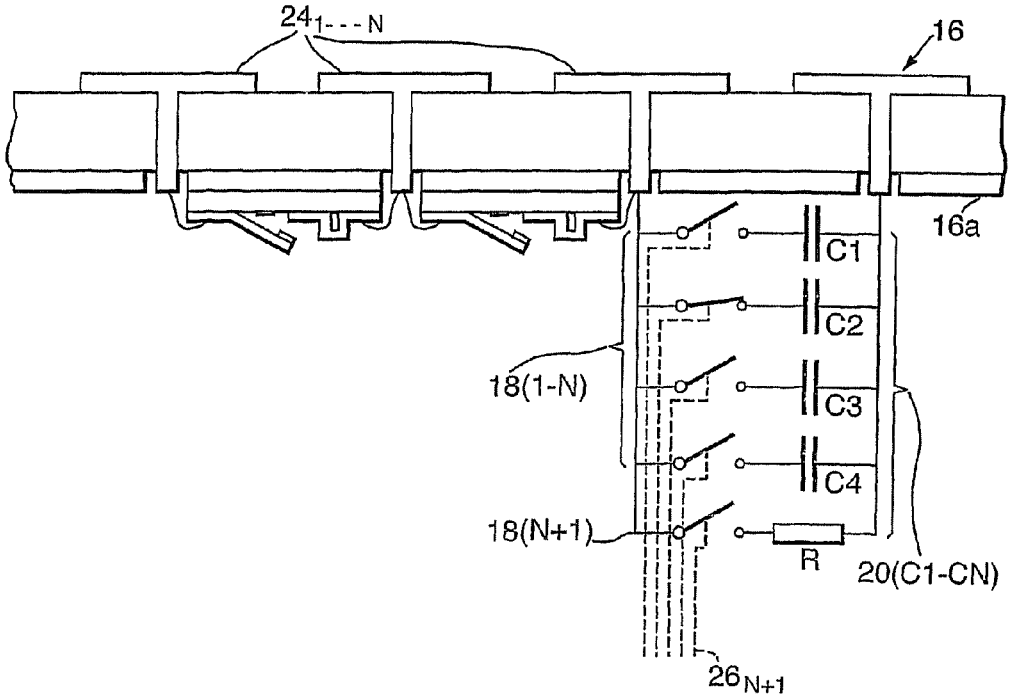
Figure 7:
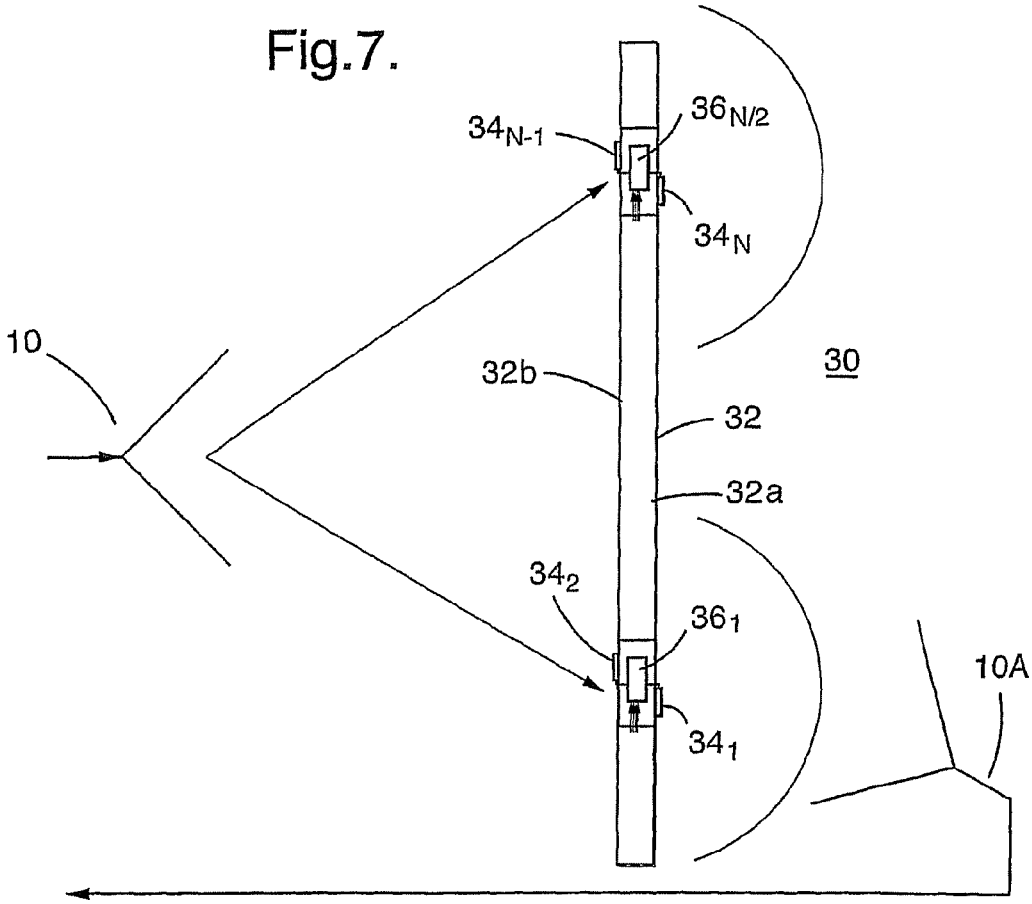
Figure 8:
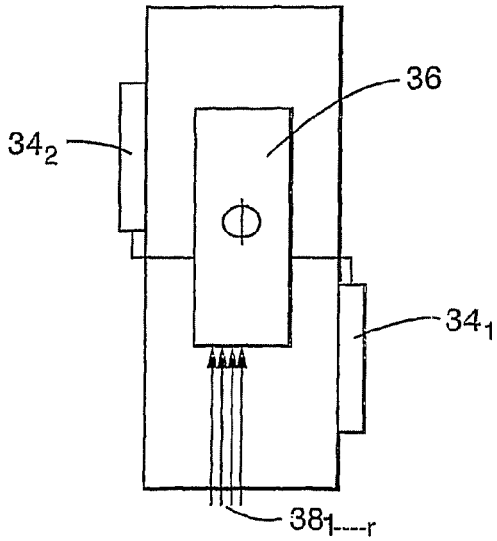
Figure 9:
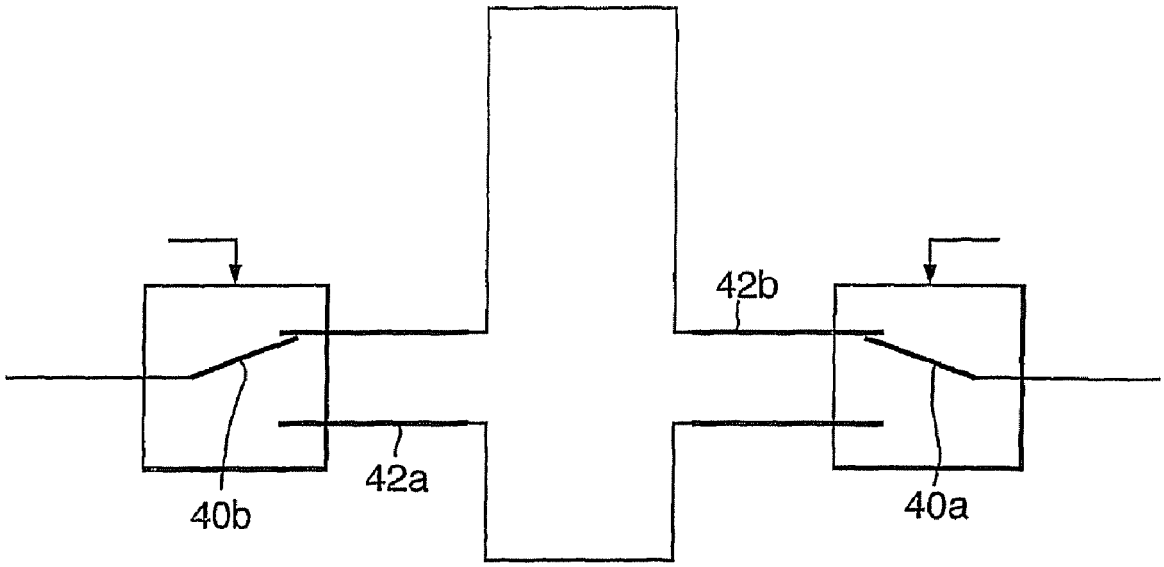

FIG. 6*a* is a schematic representation of the active high impedance surface of FIG. 4 with an alternative means of perturbing the resonant structure;

FIG. 6*b* is a schematic representation of the active high impedance surface of FIG. 6*a* with a modified means for perturbation especially for calibration of the array elements;

FIG. 7 is a simplified representation of a scanned antenna system with a transmissive antenna array panel according to a second aspect of the present invention;

FIG. 8 is a schematic representation of the phase shifting element coupled to each element of the antenna array of FIG. 7; and FIG. 9 is a schematic representation of a phase shifting element of FIG. 8 implemented in MeMs technology.

According to the present invention, phase shifting of the individual antenna elements is achieved by means of periodic electromagnetic structures. These structures may be metallic or dielectric (or a combination of both) and comprise periodic spatial variations in their structure on a scale that is much smaller than the electromagnetic wavelength and forbid propagation of electromagnetic waves in a certain frequency range. Periodic electromagnetic structures rely on the use of electrically resonant elements to provide the required behaviour and are designed so that an incident electromagnetic signal, or an applied AC signal, excites resonant electrical and magnetic fields in the structure.

Figure 1:
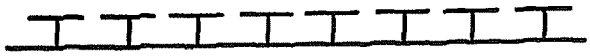
FIG. 1 is a cross-section of a periodic electromagnetic structure in the form of a high-impedance surface according to the prior art.
Figure 2:
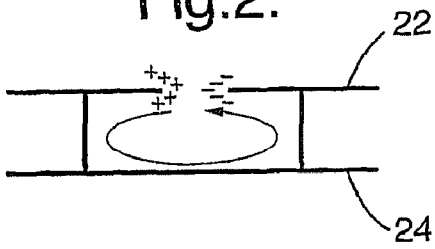
FIG. 2 is an illustration of the mechanisms that give capacitive and inductive coupling between the LC elements of FIG. 1.
Figure 3:
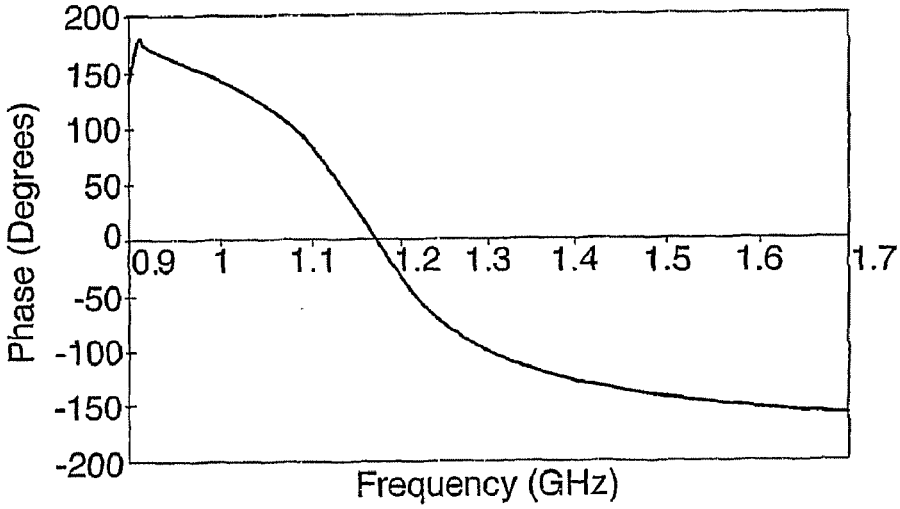
FIG. 3 is a graph illustrating how the reflection phase of a high impedance surface varies with frequency.

'High-Impedance Electromagnetic Surfaces with a Forbidden Frequency Band' by Sievenpiper et a/, published in the IEEE Transactions on Microwave Theory and Techniques 1999 volume 47 pages 2059 to 2074, discloses a high-impedance surface that comprises a flat conducting plate and resonant elements in the form of a two-dimensional array of thumbtack-like protrusions that extend from the plate as illustrated in FIGS. 1 and 2. Each of the thumbtacks can be treated as an LC circuit element where capacitance is derived from charges building up on the edges of adjacent thumbtacks and inductance is derived from current flow around a circular path between the charge accumulations. Both of these effects are shown schematically in FIG. 2. The overall effect of the thumbtacks is that the structure conducts DC, but does not conduct AC within a forbidden frequency band that is determined by the geometry of the structure. This means that the surface does not support surface waves (surface currents for the case of incident microwave radiation) and that image currents are in-phase. Moreover, the fact that it is a high-impedance surface means that it does not support surface currents and so is a very efficient reflector.

High impedance surfaces rely upon the inductive and capacitive properties of a periodically patterned array of metallic patches suspended above, but attached by vias, to a solid metallic ground plane. As the high impedance surface is a resonant structure, it has a 'high impedance' over a defined frequency range (bandwidth). The resonant frequency and bandwidth of the structure are given by the following simple equations $$\varpi_o = \frac{1}{\sqrt{LC}}$$

$$BW = \frac{\sqrt{\frac{L}{C}}}{\eta}$$

where $\overline{\omega}_o$ is the resonant frequency, L is inductance, C is capacitance, BW is the fractional bandwidth and η is the impedance of free-space.

FIG. 2 shows how the reflection phase of a high impedance surface varies with frequency. At the centre frequency (1.18 GHz in this case) the surface presents a high impedance to the flow of RF currents, and consequently reflects an incident wave with zero change in phase. As the frequency is increased, or decreased, from the resonance frequency the surface presents progressively lower impedance to the flow of RF currents and the reflection phase tends towards + and −90 degrees, ie the surface behaves like a metal sheet far from the centre frequency. The reflection phase curve has a characteristic shape, as shown in FIG. 2, over which the reflection phase varies with the frequency of incident radiation.

The basic principle of this active high impedance surface is to use a voltage dependent capacitor as the main contribution to the parallel resonant capacitor C in FIG. 1. As the value of C is changed the centre frequency of the surface is changed, i.e. the curve shown in FIG. 2 moves to higher or lower frequencies. Consequently the reflection phase at a particular frequency changes as the centre frequency of the surface is adjusted. Continuous control of the reflection phase requires a continuously variable capacitance, which is achieved by placing varactor diodes between adjacent patches. A simple high impedance surface would have the array of square patches on the upper surface and a corresponding array of vertical vias, the vias from alternate patches not connecting directly to the ground plane but passing through an array of holes in the ground plane and then connecting to the DC bias supplies. The general scheme and structure is shown in FIG. 4. Each diode may be addressed individually or in rows, so that a 2-dimensional phase profile can be applied across the surface. The use of varactor diodes allows the operating frequency of a high-impedance surface to be changed by changing the bias voltage across the varactor diode. This allows the resonant frequency of the LC elements to be changed.

Figure 5:
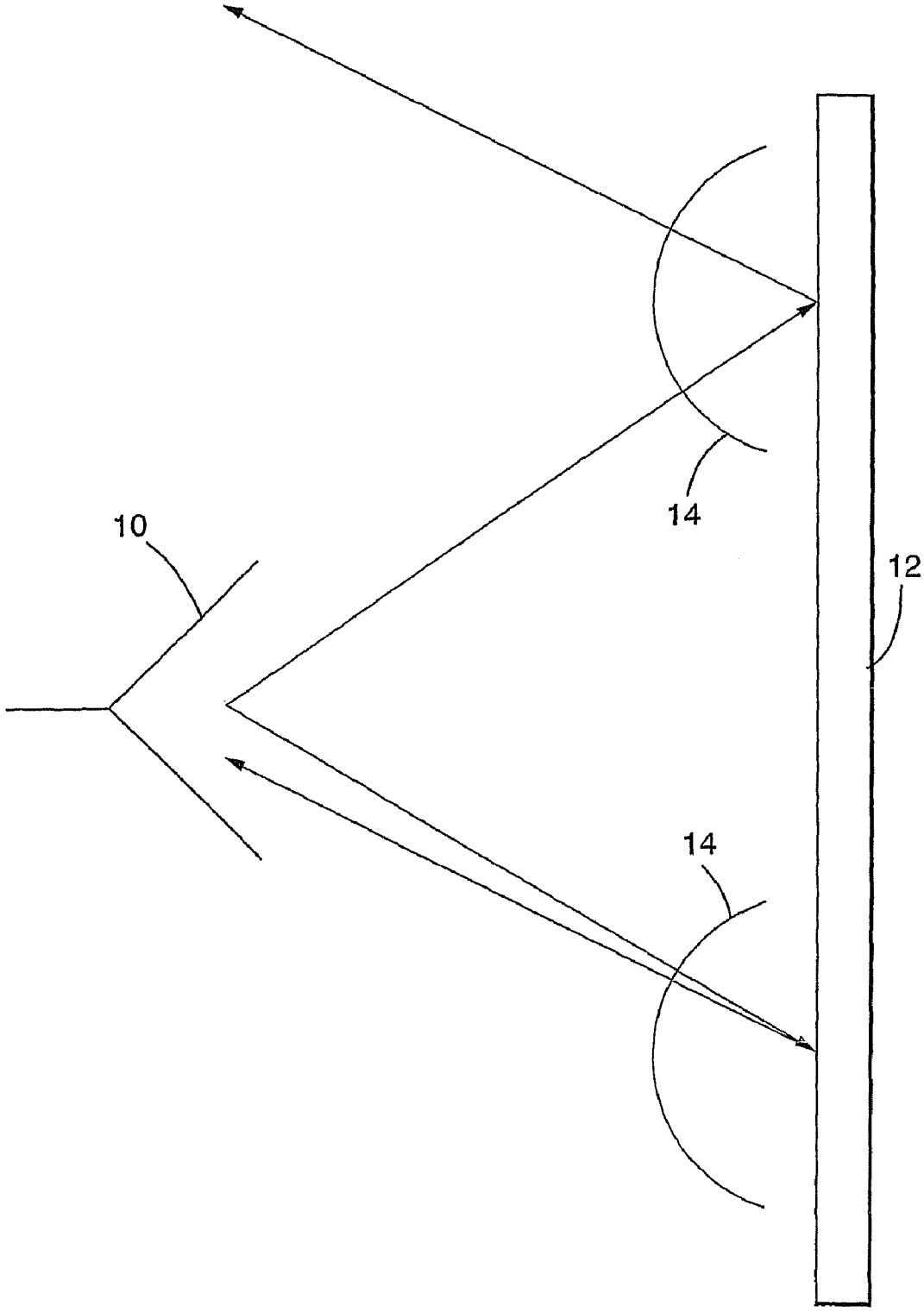
FIG. 5 is a simplified representation of a scanned antenna system with a phased reflector plate according to a preferred embodiment of the present invention.

In its simplest form, as illustrated in FIG. 5, the preferred embodiment of the invention comprises a feed horn (10) illuminating a circular flat panel (12) formed from a high impedance structure as described above. By controlling the bias voltages of the individual elements of the array, a controlled phase shift profile is applied across the surface of the panel to an incident phase front spherically spreading from the feed antenna so as to reflect that wavefront in a particular direction or impose a certain desired beam shape. The principles are reciprocal so a receiving system can also be achieved or indeed a simultaneous transmit and receive operation can be supported. The phase controlled reflecting plate advantageously performs focussing to the feed and beam scanning or beam shaping.

This concept of feed to a phased reflector plate allows the power distribution to be implemented in free space. In addition, the active component at each array element is a single varactor tuning diode per element with negligible power dissipation since it operates in reverse bias. This invention allows the feed tree to be replaced by a free space spherically spreading wave emerging from a feed antenna which has minimal loss compared to the guided wave structure of the feed tree. The active element at each array antenna is a single varactor diode so offer substantially lower cost over the phased array concept. The number of active devices per element is significantly less and they are less stressed and less delicate compared to low noise amplifiers and power amplifiers. In addition, the minimal size of the varactor control element provides the opportunity of a denser array which offers superior sidelobe structure particularly at large angles away from the main lobe or surface normal.

As with conventional phased array systems, the antenna system described above is likely to suffer a drift effect which will mean that the voltage to phase relationship of each array element, whilst remaining monotonic, may develop a phase error. Since each elemental sub-section of the panel needs to apply a phase shift to focus the beam and to scan it, this drift would result in defocusing, (i.e., causing loss of main lobe gain and an increase in the side lobe levels and also in imperfect beam pointing. This antenna can be calibrated by each element being measured for offset and slope errors in their assumed voltage to phase relationship. Each of the elements of the high impedance surface array can be regarded as having the ability to form a Huygens source having a hemispherical emergent wave front (14) (shown in FIG. 5) whose phase relation to the incident wave front is controllable by varying the varactor bias voltage.

In order to measure and correct any drift in the antenna, a modulation is applied to the varactor bias voltage of a particular elemental sub-section of the panel. Since part of the emergent Huygens wave front (14) from a particular element will impinge on the feed antenna, the phase difference between the incident wave front and the emergent wave front could then be measured for the signal path from the feed to the element and back to the feed as a modulo $2\pi$ remainder. The path between the feed and the particular element of the panel will have a constant predetermined length provided the panel and feed are in strict mechanical register. Due to the non-linear nature of the voltage to phase relationship of each element, the modulation should be repeated at several points along the assumed voltage to phase characteristic and the offset and the slope should be determined from the phase excursion divided by modulation voltage and applying appropriate polynomial coefficients thereto. Using this offset estimate and the slope estimate, the voltage required to achieve any phase shift (e.g., the phase shift required to develop a flat wave front with its normal pointing in a particular direction) can be calculated.

Since the offset estimate is likely to be corrupted by radiation from other elements falling on the feed, while a particular elemental sub-zone of the panel is being calibrated by the modulation, the bias voltages applied to the other elements may be set using the notional phase to voltage relationship required to achieve cancellation of their radiation at the feed point. If necessary, the process may be repeated with a revised relationship. Alternatively, the elements not being calibrated can be switched off by biasing them to resonance so that they become completely absorbing. This resonance point can be determined by applying a modulation bias with an offset and varying the offset until the phase shift detected becomes minimized.

Since the operation of the high impedance surface panel is based on a resonance phenomenon which is inherently narrow band, it may be necessary to re-optimise the phase shifts to suit each frequency step in a transmitted waveform.

An alternative means of perturbing the resonant structure formed by the high impedance surface is to switch additional elements into the resonator circuit. FIG. 6*a* shows a high impedance surface structure 16 where a set of parallel RF switches 18(1-N) are mounted on the rear surface 16*a* thereof that selectively connect lumped capacitances 20(C1-CN) to the stems 22 of each of the elements $\mathbf{24}_1 \ldots \mathbf{24}_n$ of the array. The switches 18(1-N) are actuated by a set of N control lines $\mathbf{26}_1 \ldots \mathbf{26}_N$ and the values of the capacitances 20(C1-CN) are selected so as to achieve in the region of 360 degrees phase control of the reflected wave in $2^N$ discrete steps. The phase shift is quantized with the smallest increment in phase being determined by the number of switches N on each element $\mathbf{24}_1 \ldots \mathbf{24}_n$. For example, using four switches as illustrated in FIG. 6*a*, a precision of 22.5 degrees will be achieved. However, it should be understood that N may be any appropriate value and the greater the value of N, the greater the precision of the phase shift. The phase shifts arising from the C1 to CN capacitances 20 operating alone are in the sequence ½, ¼ ⅛ 1/16 . . . $1/2^N$ The switches 1-N may be single-pole, single-throw RF micro electromechanical switches (MeMs) and may be actuated electrostatically or may comprise bimetal structures actuated by a heating current. Both of these types of switches may be formed as miniature structures fabricated to high precision by lithographic techniques similar to those of semiconductor fabrication. It is possible to include the RF capacitances C1-CN or other RF passive circuit elements on such the substrate of such MeMs switches. This is advantageous in that only two RF interconnections per element are required during assembly which compares very favourably with the skilled assembly labour associated with the T/R modules of conventional phased array systems. Moreover, when such MeMs switches are actuated electrostatically, the power dissipation required to maintain a particular switch state is very low.

MeMs switches generally offer low RF transmission loss when the switch is closed and since they are intrinsically reciprocal in both switch states, monostatic operation of the antenna is achieved. Furthermore, as passive structures, MeMs switches are intrinsically linear devices and offer superior power handling capability compared to RF semiconductor control devices such as PIN diodes or Monolithic Microwave FET devices. When a MeMs switch is in its open state, a reactive impedance is presented at the terminals so the switch is reflective rather than dissipative. Switching times of typically less than 30 microseconds can be achieved and while the actuation of an electrostatically actuated switch may require 60 to 110 Volts, the current required is minimal. A digital TTL control circuit may readily control such a low energy bias by means of a MOSFET transistor.

As is illustrated in FIG. 6*a*, the device size of a MeMs switch set 18 with integrated RF components 20(C1-CN) (e.g. capacitors, inductors and resistors) is sufficiently small to allow direct mounting on the rear surface 16*a* of the high impedance surface structure 16 and accommodation within the pitch of the resonators which are less than half the free space wavelength at the frequency of antenna operation. In operation, device sizes of less than this maximum pitch (i.e. <4 mm) at 35 GHz have been achieved.

Advantageously, the high impedance surface structure 16 may be included in the MeMs fabrication so as to achieve a fully integrated antenna.

FIG. 6*b* illustrates an adaptation of the circuit of FIG. 6*a* to facilitate calibration of the array. An additional switch 18(N+1) and resistor limb R are inserted in parallel with the N switches 18(1-N) and capacitances 20(C1-CN) associated with each array element $\mathbf{24}_1 \ldots \mathbf{24}_n$. The value of resistance R is selected so as to achieve complete absorption of the incident RF wave impinging on that element when the additional switch 18(N+1) is closed by means of an associated control line $\mathbf{26}_{N+1}$. By controlling all elements $\mathbf{24}_1 \ldots \mathbf{24}_n$ of the array but the single element being calibrated in such a manner, all other elements can be made completely absorbing allowing the independent calibration of each individual element $\mathbf{24}_1 \ldots \mathbf{24}_n$. This is analogous with the calibration scheme described earlier in relation to the varactor array, with the switch state control corresponding to the varactor bias and selection of the absorptive state corresponding to absorptive resonance.

A further embodiment of the invention will now be described with reference to FIGS. 7, 8 and 9. As illustrated in FIG. 7, the array 30 comprises a panel 32 having a plurality of small patch antenna elements $\mathbf{34}_{1 \ldots N}$ disposed on opposing outer surfaces 32*a*, 32*b* thereof. In the interior of the panel 32 between the patch antenna surfaces, a plurality of phase shifter devices $\mathbf{36}_{1 \ldots N/2}$ are provided, each phase shifter $\mathbf{36}_{1 \ldots N/2}$ being connected to two elements $\mathbf{34}_1$, $\mathbf{34}_2$, one on either surface of the panel 32. The configuration of an individual phase shifter 36 with respect to the panel is shown in FIG. 8. The phase shift is controlled by means of a plurality of control lines $\mathbf{38}_{1 \ldots r}$ coupled to the phase shifter 36 and hence to the two elements $\mathbf{34}_1$, $\mathbf{34}_2$ coupled thereto.

The phase shifting devices $\mathbf{36}_{1 \ldots N/2}$ can be implemented in a variety of ways and are preferably reciprocal phase shifting elements so as to allow the antenna to be used monostatically. Reciprocal phase shifting elements are well known when implemented using PIN diodes but recent developments in micro electromechanical switch technologies can be utilized to advantageously implement such reciprocal phase shifting elements. Such an implementation using MeMs switches is illustrated in FIG. 9, wherein single-pole, single-throw RF switches 40*a*, 40*b* are provided at either end of a pair of dissimilar length RF transmission lines 42*a*, 42*b*. The difference in length between the pair of transmission lines 42*a*, 42*b* is selected to fall within the set of 180, 90, 45, 22.5, . . . , such that when one of each type is cascaded, the assembly has a total phase shift that can be selected by the associated control lines $\mathbf{38}_{1 \ldots r}$ to achieve any phase angle between 0 and 360 degrees to a precision determined by the least significant bit phase shift. For example, a four bit phase shifter (i.e., 16 individual states) can be implemented to achieve any particular phase shift to a precision of 22.5 degrees. However, it should be understood that any appropriate number of control lines may be used in order to achieve the desired phase shift precision.

Implementation of the phase shifting devices using MeMs technology offer many advantages, in that RF propagation occurs through materials having good dielectric properties rather than through semiconductor material. For this reason, the devices exhibit low losses, intrinsic linearity and are completely reciprocal. Moreover, the devices are capable of tolerating high RF power levels passing through the switches without affecting the transmission phase.

Calibration of the array 30 is achieved in a similar manner to the reflector array described earlier with reference to FIG. 5, however with a second feed horn 10A being provided on the opposite side of the array to the feed 10 to sample the emergent wave phase, as illustrated in FIG. 7. Since the MeMs phase shifter 36 is implemented using single pole, single throw RF switches 40*a*, 40*b*, it is possible to inhibit all transmission by setting all switches associated with each element open. Hence during calibration, transmission by all but one element of the array can be inhibited allowing the characteristics of that element to be measured in isolation. This is analogous to biasing all the varactors but one in the reflector array described earlier to absorptive resonance during calibration.

It should be understood that the calibration processes described with respect to all the different embodiments of the invention can be carried during a distinct calibration mode of radar operation at a particular appropriate time or alternatively, may be interleaved with the radar waveform.

Although the embodiment of the present invention has been described in the context of a simple feed horn illuminating a circular flat panel formed from a high impedance surface structure, it should be understood that various other embodiments, configurations and applications are envisaged. For example, the phased reflector plate may have any other appropriate shape depending of course, on the application in which it is to be used. Non-planar high impedance surfaces may also form a reflector array. It should be understood that the feed horn could be replaced with a feed supporting a monopulse feed in one or two planes or with another more elaborate array feed. Alternatively, an offset feed may be used. In order to improve jamming immunity, known null steering techniques could be incorporated. The antenna system of the present invention may be used in ground or air based military and/or civilian radar applications and may be used as a communications adaptive antenna.

Although some of the embodiments of the present invention have being described in the context of a high impedance surface, it should be understood that other periodic electromagnetic structures may be used. Other periodic electromagnetic structures that rely on resonance phenomena are 'ultra compact photonic bandgap' structures (UC-PBG), such as disclosed in 'Aperture-Coupled Patch Antenna on UC-PBG Substrate' by Coccioli et al, published in the IEEE Transactions on Microwave Theory and Techniques 1999 volume 47 pages 2123 to 2130 and 'negative refractive index' materials, such as disclosed in 'Composite Medium with Simultaneously Negative Permeability and Permittivity' by Smith et a/, published in Physical Review Letters 2000 volume 84 pages 4184 to 4187.

The invention claimed is:

1. An antenna system comprising feed means for transmitting a wave front; and a panel adapted to apply a predetermined phase shift to the transmitted wave front, the panel comprising an array of antennae elements formed on a periodic electromagnetic structure and control means associated with each element for controlling the resonant frequency of the element, wherein independent calibration of individual elements of the antenna system is performed by controlling the resonant frequency of all other elements of the array but the element to be calibrated, to a state in which the RF radiation of each element at the feed point is cancelled or an incident RF wave impinging on each element is completely absorbed.

2. An antenna system according to claim 1, wherein the periodic electro-magnetic structure is a high impedance surface.

3. An antenna system according to claim 1, wherein the control means comprises a varactor disposed between adjacent elements of the array and wherein cancellation of the element radiation at the feed point is achieved by biasing the varactor at a predetermined phase to voltage relationship.

4. An antenna system according to claim 1, wherein the control means comprises a varactor disposed between adjacent elements of the array and wherein complete absorption of an incident RF wave impinging on the element is achieved by biasing the varactor to the resonance point of the element.

5. An antenna system according to claim 4, wherein the resonance point for an element is determined by applying a modulation bias with an offset and varying the offset until the phase shift detected becomes minimized.

6. An antenna system according to claim 1, wherein the control means comprises a set of parallel RF MeMs switches (1-N) coupled to each element of the array, and wherein cancellation of the element radiation at the feed point is achieved by selectively connecting lumped capacitances (C1-CN) to each element.

7. An antenna system according to claim 6, wherein the switches (1-N) are actuated by a set of N control lines and the values of the capacitances (C1-CN) are selected so as to achieve in the region of 360 degrees phase control of the reflected wave in $2^N$ discrete steps.

8. An antenna system according to claim 7, wherein the smallest increment in phase is determined by the number of switches N on the elements of the array.

9. An antenna system according to claim 1, wherein the control means comprises a set of parallel MeMs switches (1-N+1) coupled to each element with one of said switches (N+1) being coupled to a predetermined resistance R, and wherein complete absorption of an incident RF wave impinging on the element is achieved by closing the switch (N+1) of the MeMs switch set associated with that element.

10. An antenna system according to claim 9, wherein the set of parallel MeMs switches are directly mounted on the rear surface of the high impedance structure.

11. An antenna system according to claim 9, wherein the high impedance surface structure may be included in the MeMs fabrication so as to achieve a fully integrated antenna.

12. A method of calibrating a scanned antenna system, the antenna system feed means for transmitting a wave front; and a panel adapted to apply a predetermined phase shift to the transmitted wave front, the panel comprising an array of antenna elements formed on a periodic electro-magnetic structure with control means associated with each element of the array arranged to vary the resonant frequency of the element, the method comprising:

(a) varying the resonant frequency of all but a single element of the array to be calibrated, to a state in which the RF radiation of each element at the feed point is cancelled or an incident RF wave impinging on each element is completely absorbed;

(b) modulating the resonant frequency of the single element to be calibrated;

(c) determining the phase difference between an incident wave front and the emergent wave front from the antenna array;

(d) calculating estimate values for the phase offset of the element to be calibrated from the measured differences;

(e) determining the calibration required to achieve a predetermined phase shift on the basis of the estimated values; and repeating steps (a) to (e) for all elements of the array.

13. A method according to claim 12, wherein the periodic electro-magnetic structure panel is a high impedance surface and wherein the control means comprises a varactor disposed between adjacent elements of the array and wherein step (a) comprises biasing the varactors at a predetermined phase to voltage relationship to achieve cancellation of the element radiation at the feed point.

14. A method according to claim 12, wherein the periodic electro-magnetic structure panel is a high impedance surface and the control means comprises a varactor disposed between adjacent elements of the array and wherein step (a) comprises biasing the varactors to the resonance point of each element so as to achieve complete absorption of an incident RF wave impinging on the element.

15. A method according to claim 14, wherein the resonance point for an element is determined by applying a modulation bias with an offset and varying the offset until the phase shift detected becomes minimized.

16. A method according to claim 12, wherein the periodic electro-magnetic structure panel is a high impedance surface and the control means comprises a MeMs RF switch network coupled to each element of the array and wherein step (a) comprises selectively connecting lumped capacitances (C1-CN) to each element to achieve cancellation of the element radiation at the feed point.

17. A method according to claim 12, wherein the periodic electro-magnetic structure panel is a high impedance surface and the control means comprises a MeMs RF switch network coupled to each element of the array and wherein step (a) comprises closing an additional switch coupled to a predetermined resistance R on each switch network to achieve complete absorption of an incident RF wave impinging on that particular element.

18. A method according to claim 12, wherein calibration is performed repeatedly or is interleaved with the radar or communications waveforms passing through the antenna.

* * * * *